US007469999B2

(12) United States Patent
Kadomatsu et al.

(10) Patent No.: US 7,469,999 B2
(45) Date of Patent: Dec. 30, 2008

(54) IMAGE FORMING APPARATUS AND METHOD

(75) Inventors: Tetsuzo Kadomatsu, Kanagawa (JP); Masaaki Konno, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 432 days.

(21) Appl. No.: 11/088,026

(22) Filed: Mar. 24, 2005

(65) Prior Publication Data

US 2005/0212871 A1 Sep. 29, 2005

(30) Foreign Application Priority Data

Mar. 25, 2004 (JP) ..... 2004-090259

(51) Int. Cl.
*B41J 2/01* (2006.01)

(52) U.S. Cl. ..... 347/55; 347/14; 347/102

(58) Field of Classification Search ..... 347/102, 347/104, 220, 55, 6, 9, 101, 54, 2, 14; 271/276
See application file for complete search history.

(56) References Cited

U.S. PATENT DOCUMENTS 5,896,148 A * 4/1999 Fukushima et al. ..... 347/67
7,152,970 B2 * 12/2006 Hasebe et al. ..... 347/102
2005/0206683 A1 * 9/2005 Kusunoki ..... 347/55

FOREIGN PATENT DOCUMENTS

| | | | |
|---|---|---|---|
| JP | 5-4342 A | | 1/1993 |
| JP | 5-4343 A | | 1/1993 |
| JP | 5-330034 A | | 12/1993 |
| JP | 06143555 A | * | 5/1994 |
| JP | 2000-246981 A | | 9/2000 |

* cited by examiner

*Primary Examiner*—Manish S Shah
(74) *Attorney, Agent, or Firm*—Birch, Stewart, Kolasch & Birch, LLP

(57) ABSTRACT

The image forming apparatus includes: an ejection head which ejects ink having electrorheological properties toward a recording medium; an electric field application device which applies an electric field to droplets of the ink deposited on a surface of the recording medium; an electric field intensity control device which controls intensity of the electric field in such a manner that the ink in the droplets has a prescribed viscosity; and a fixing promotion device which carries out processing for promoting fixing of the ink on the recording medium, in a state where the electric field is applied by the electric field application device.

11 Claims, 11 Drawing Sheets

IMAGE FORMING APPARATUS AND METHOD

BACKGROUND OF THE INVENTION

1. Field of the Invention

The present invention relates to an image forming apparatus and method, and more particularly, to an image forming technology suitable for an image forming apparatus, such as an inkjet recording apparatus which forms images on a recording medium by ejecting liquid droplets from nozzles.

2. Description of the Related Art

Japanese Patent Application Publication Nos. 5-4342 and 5-4343 disclose technology for using an electrorheological fluid in a recording apparatus based on an inkjet type of recording head, in order to prevent smearing and color mixing of ink, and the like, on the recording medium.

Japanese Patent Application Publication No. 5-4342 discloses a recording apparatus in which a recording liquid having electrorheological properties is formed into droplets by a recording head and caused to adhere to an intermediate transfer medium having an electric field created on the surface thereof, thereby raising the viscosity of the droplets on the transfer medium. The recording liquid is then transferred in this state of increased viscosity onto a transfer receiving medium, thereby preventing excessive spreading or color mixing caused by the recording head.

In the recording apparatus described in Japanese Patent Application Publication No. 5-4343, a recording liquid having electrorheological properties is formed into droplets by a recording head and caused to adhere to a transfer medium formed with an electric field, whereby the viscosity or yield value of the droplets of recording liquid is increased instantaneously. Therefore, blurring, smearing or color mixing of the recorded dots is prevented.

However, in the recording apparatus described in Japanese Patent Application Publication No. 5-4342, time is required for the recording droplets to dry on the intermediate transfer medium, and this leads to a decline in recording speed. Furthermore, if the image is transferred in a state where an electric field is applied, as in Japanese Patent Application Publication No. 5-4342, then it is not possible to control smearing after transfer.

On the other hand, in the recording apparatus described in Japanese Patent Application Publication No. 5-4343, even if it is possible to restrict the rate of smearing of the recording dots by applying an electric field, smearing of the recording dots still continues for a long period of time after the electric field is removed.

SUMMARY OF THE INVENTION

The present invention has been contrived in view of such circumstances, and an object thereof is to provide an image forming apparatus and method which can achieve high-quality image formation by controlling the viscosity of deposited ink in order to reduce interference between liquid droplets on the recording medium and movement of the liquid (landing interference), and hence cause the droplets to become fixed reliably in a satisfactory dot configuration.

In order to attain the aforementioned object, the present invention is directed to an image forming apparatus, comprising: an ejection head which ejects ink having electrorheological properties toward a recording medium; an electric field application device which applies an electric field to droplets of the ink deposited on a surface of the recording medium; an electric field intensity control device which controls intensity of the electric field in such a manner that the ink in the droplets has a prescribed viscosity; and a fixing promotion device which carries out processing for promoting fixing of the ink on the recording medium, in a state where the electric field is applied by the electric field application device.

According to the present invention, an ink having electrorheological properties is used, and ink is ejected from an ejection head toward a recording medium. The ink droplets deposited onto the recording medium are increased in viscosity by the action of the electric field, thereby restricting the permeation of the ink into the recording medium and excessive spreading of the dot size, while also suppressing interference between ink droplets and movement of the liquid on the surface of the recording medium. When applying an electric field, by controlling the electric field intensity appropriately in order that the deposited ink droplets assume a prescribed viscosity, it is possible to achieve a prescribed liquid state and hence interference between deposited ink droplets can be suppressed. Furthermore, since a fixing promotion process is implemented while the ink is in a highly viscose liquid state, fixing of the ink advances and virtually no smearing or color mixing occurs after the electric field has been removed, thus making it possible to form images of high quality.

Furthermore, desirably, control is implemented in such a manner that the minimum electric field necessary in order to prevent landing interference, smearing, and the like, is applied. By this means, it is possible to prevent increase in the viscosity of the ink inside the ejection head.

Preferably, the image forming apparatus further comprises: a medium information acquiring device which acquires information relating to a state of the recording medium, wherein the electric field intensity control device controls the electric field intensity according to the information acquired by the medium information acquiring device.

Further beneficial effects are obtained if the state of the recording medium is ascertained by means of a medium information acquiring device and the electric field intensity is adjusted in accordance with this state of the medium, in order to prevent variation in the electric field intensity actually applied to the deposited ink, due to conditions such as the thickness of the recording medium, the dielectric constant thereof, and the like.

In a desirable mode, the electric field intensity control device is composed in such a manner that the electric field intensity is adjusted automatically on the basis of the information acquired from the medium information acquiring device. However, it is also possible to adopt a mode in which the electric field intensity is switched or changed by means of manual controls performed by the operator.

Preferably, the medium information acquiring device comprises a surface potential determining device which determines an electric potential at the surface of the recording medium.

By determining the electric potential at the surface of the recording medium and controlling the electric field intensity on the basis of the determination results, it is possible to keep the potential at the surface of the recording medium, which may fluctuate with the thickness or dielectric constant of the recording medium, or the like, in an optimal state at all times. Therefore, the deposited ink can be set to a desired viscosity.

Preferably, the medium information acquiring device comprises a recording medium type determining device which determines a type of the recording medium.

Since the permeability of the ink with respect to the recording medium depends on the type of recording medium, it is possible to achieve a desired speed of permeation by controlling the intensity of the electric field to an appropriate value. Therefore, smearing can be prevented effectively.

The recording medium type determining device may comprise, for example, a device which measures the reflectivity of the recording medium, or a device which reads in the type of the recording medium used from the ID, or the like, of the supply magazine. Furthermore, the medium information acquiring device is not limited to the surface potential determining device, the recording medium type determining device, or a combination of same, and a composition may also be adopted in which a user inputs the paper type, and other information relating to the recording medium, by means of a prescribed input device, or the like.

Preferably, the ink is a radiation-curable ink; and the fixing promotion device comprises a radiation irradiating device which irradiates radiation that causes the ink to harden.

More specifically, the printing ink used is a radiation-curable ink having the property of hardening when exposed to radiation (electromagnetic waves including visible light, ultraviolet (UV) light and X-rays, and an electron beam, or the like). A radiation irradiating device which causes the ink to harden is provided. Typical examples of a radiation-curable ink are: a UV-curable ink (UV ink), and an electron beam (EB) curable ink (EB ink).

According to the embodiments of the present invention, the hardening reaction of ink droplets formed on the surface of the recording medium can be promoted and the ink can be hardened and fixed to a level at which smearing, or the like, does not occur, by irradiating radiation onto ink droplets on the surface of the recording medium, in a state where the viscosity of the deposited droplets has been raised and the speed of permeation of the ink into the recording medium has been slowed by application of an electric field (in other words, a state where permeation and spreading of the ink into the recording medium has been restricted).

Preferably, the image forming apparatus further comprises: an electrostatic attraction device which holds the recording medium by means of electrostatic attraction, wherein the electrostatic attraction device functions as the electric field application device.

An electric field can be applied to the ink on the recording medium by using the electric field of an electrostatic suction device (for example, a belt or roller) which holds the recording medium. Various other modes of the electric field application device are possible, such as (a) a mode where the ink is held between plate-shaped electrodes having a high potential difference; (b) a combination of charging the recording medium and ink by means of a conductive rubber roller, a conductive brush, corona discharge, or the like, and positioning electrodes in the vicinity of the recording medium; (c) a combination of charging the recording medium and the ink by irradiating an electron beam or ion beam onto the recording medium, or the ink on the recording medium, and positioning electrodes in the vicinity of the recording medium; (d) a combination of charging the actual ink droplets by passing the ink droplets through an electric field when in flight, and positioning electrodes in the vicinity of the recording medium; and the like.

Preferably, the image forming apparatus further comprises an earthed electrode member which is arranged on at least an ejection surface side of the ejection head.

Desirably, the distribution of the electric field (the flow of the lines of electric force) between the recording medium and the ejection head is controlled by disposing earthed electrodes on the ejection surface side of the ejection head, in order to reduce the effects of the electric field on the nozzle section of the ejection head (the liquid droplet ejecting ports). Thereby, it is possible to prevent increase in the viscosity of the ink inside the ejection head, and hence the occurrence of ejection faults can be prevented.

Preferably, the image forming apparatus further comprises a static-elimination device which removes electrical charge from the recording medium after processing by the fixing promotion device.

By adding a device for removing the electrical charge from the charged recording medium and thus removing the charge from the recording medium after the fixing promotion process, it is possible to prevent the recording medium from attracting other recording media, dust, or the like.

In order to attaint the aforementioned object, the present invention is also directed to an image forming method, comprising: an ink ejection step of ejecting ink having electrorheological properties toward a recording medium from an ejection head; an electric field application step of applying an electric field to droplets of the ink deposited on a surface of the recording medium; an electric field intensity control step of controlling intensity of the electric field in such a manner that the ink in the droplets has a prescribed viscosity; and a fixing promotion step of carrying out processing for promoting fixing of the ink on the recording medium, in a state where the electric field is applied in the electric field application step.

A compositional example of an ejection head is a full line type inkjet head having a nozzle row in which a plurality of nozzles for ejecting ink are arranged through a length corresponding to the full width of the recording medium. If forming a color image, full line ink jet heads relating respectively to one of a plurality of colors are installed.

A full line type inkjet head is usually disposed in a direction that is orthogonal to the relative feed direction (relative conveyance direction) of the recording medium, but modes may also be adopted in which the inkjet head is disposed following an oblique direction that forms a prescribed angle with respect to the direction orthogonal to the conveyance direction. Moreover, a mode may also be adopted in which a row of nozzles corresponding to the full width of the recording paper is constituted by combining a plurality of short recording head units having nozzle rows which do not reach a length corresponding to the full width of the recording medium.

"Recording medium" indicates a medium on which an image is recorded by means of the action of the ejection head (this medium may also be called a print medium, image forming medium, image receiving medium, or the like). This term includes various types of media, irrespective of material and size, such as continuous paper, cut paper, sealed paper, resin sheets, such as OHP sheets, film, cloth, a printed circuit board on which a wiring pattern, or the like, is formed by means of an ejection head, and the like.

The movement device for causing the recording medium and the ejection head to move relatively to each other may include a mode where the recording medium is conveyed with respect to a stationary (fixed) ejection head, or a mode where an ejection head is moved with respect to a stationary recording medium, or a mode where both the ejection head and the recording medium are moved.

According to the present invention, using ink having electrorheological properties, the viscosity of deposited ink droplets on the recording medium is raised to a prescribed viscosity by controlling the electric field intensity, thereby effectively suppressing landing interference, smearing and spreading of the ink, and the like, and processing for promoting fixing is performed in this state. Therefore, it is possible to achieve high-quality image formation.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

First Embodiment; General Configuration of an Inkjet Recording Apparatus

Figure 1:
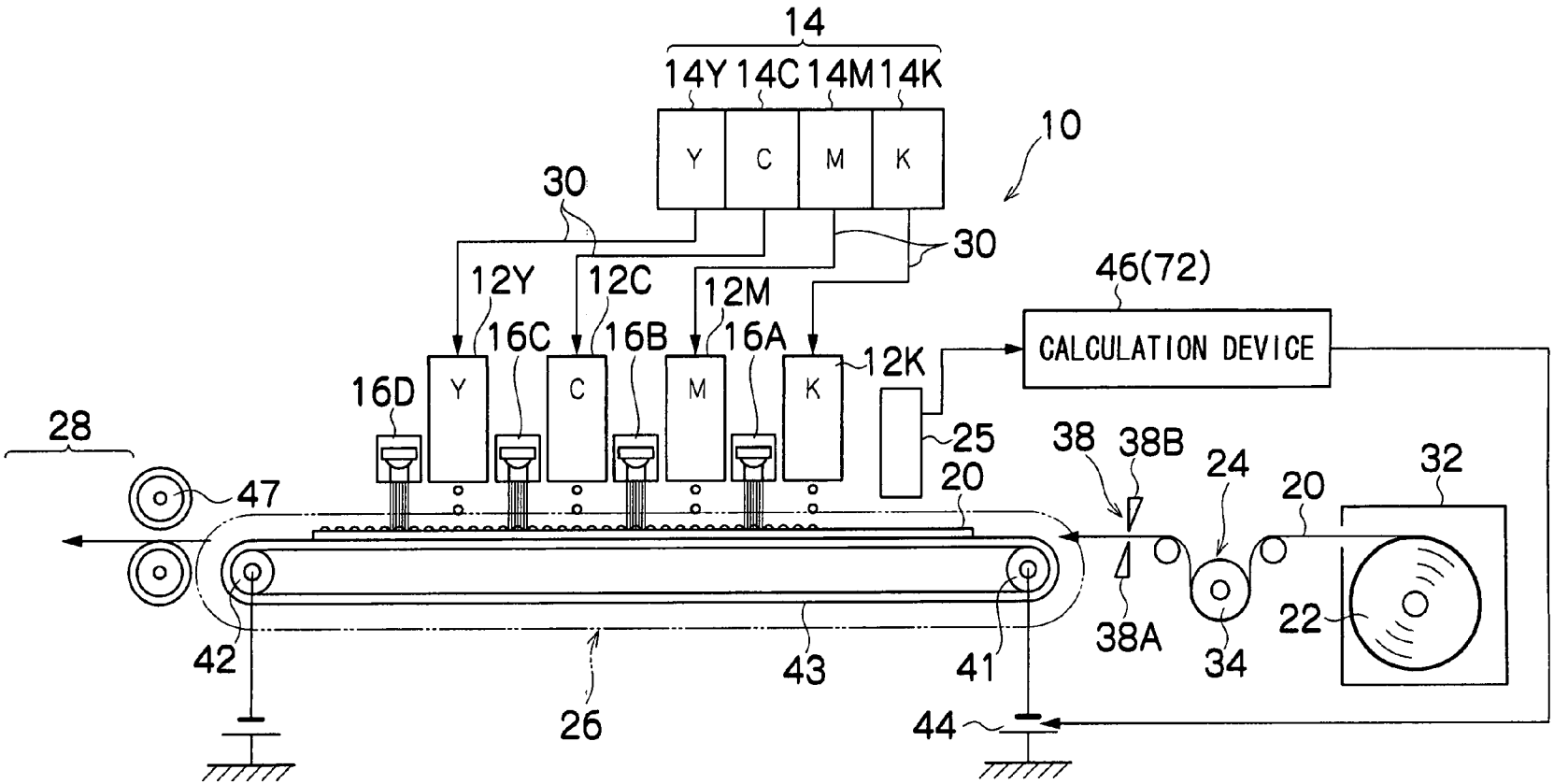
FIG. 1 is a general schematic drawing of an inkjet recording apparatus according to an embodiment of the present invention.

FIG. 1 is a general schematic drawing of an inkjet recording apparatus for forming an image by ejecting inks as droplet onto a recording medium, according to an embodiment of the present invention.

As shown in FIG. 1, the inkjet recording apparatus 10 comprises: a plurality of print heads 12K, 12M, 12C, and 12Y for ink colors of black (K), magenta (M), cyan (C), and yellow (Y), respectively; an ink storing/loading unit 14 for storing inks (in this embodiment, ultraviolet (UV) curable inks which have electrorheological properties) to be supplied to the print heads 12K, 12M, 12C, and 12Y; a medium supply unit 22 for supplying a medium (recording medium) 20; a decurling unit 24 for removing curl in the medium 20; a surface potential sensor 25 for measuring potential on surface of the medium 20, an electrostatic suction belt conveyance unit 26 disposed facing the nozzle face (ink-droplet ejection face) of the print unit 12 and light emitting faces of UV light sources 16A to 16D, for conveying the medium 20 while keeping the medium 20 flat; and a medium output unit 28 for outputting image-recording medium 20 (printed matter) to the exterior.

The ink storing/loading unit 14 has ink tanks 14K, 14M, 14C, and 14Y for storing the inks to be supplied to the print heads 12K, 12M, 12C, and 12Y, and the tanks are connected to the print heads 12K, 12M, 12C, and 12Y through channels 30, respectively. The ink storing/loading unit 14 has a warning device (e.g., a display device, an alarm sound generator) for warning when the remaining amount of any ink is low, and has a mechanism for preventing loading errors among the colors.

In the present embodiment, an electrorheological fluid obtained by imparting a UV-curable ink with electrorheological properties is used as the printing ink. An electrorheological fluid is a fluid in which the apparent viscosity rises instantaneously when an electric field is applied. The change in viscosity is reversible by switching the electric field on and off. There are two types of electrorheological fluids: dispersed fluids and uniform fluids.

A dispersed type fluid is one in which dielectric micro-particles are dispersed in an electrically insulating solvent. This fluid behaves in such a manner that when no electric field is applied, the micro-particles remain in a dispersed state and the viscosity of the fluid is low, but when an electric field is applied, the polarized particles form chain-like structures ("bridges") linked in the direction of the electric field, and these bridges act so as to increase the viscosity of the fluid. Dispersed type electrorheological fluids include aqueous and non-aqueous fluids.

On the other hand, uniform type electrorheological fluids have anisotropic properties in which molecules or domains are oriented in the direction of the electric field, such as liquid crystals, or the like. Since the uniform type electrorheological fluids currently display little change in viscosity, it is thought that dispersed type electrorheological fluids are more suitable for use in inkjet printers.

In the present embodiment, a radiation-curable ink is imparted with electrorheological properties, and an ink of this kind may be created, for example, by dispersing solid micro-particles (silica gel, starch, dextrin, carbon, gypsum, gelatin, alumina, cellulose, mica, zeolite, kaolite, or the like) in a liquid containing at least a radiation-curable monomer and a polymerization initiator, by using the actual pigment micro-particles as a dispersant for creating the electrorheological properties, by forming the dye or pigment into micro-capsules, providing insulation on the surface thereof, and using these micro-capsules as a dispersant for creating the electrorheological properties, or by combining a uniform type electrorheological fluid.

In FIG. 1, a single magazine 32 for rolled paper (continuous paper) is shown as an example of the medium supply unit 22; however, a plurality of magazines with paper differences such as paper width and quality may be jointly provided. Moreover, paper may be supplied with a cassette that contains cut paper loaded in layers and that is used jointly or in lieu of a magazine for rolled paper.

In the case of a configuration in which a plurality of types of media can be used, it is preferable that an information recording medium such as a bar code and a wireless tag containing information about the type of medium is attached to the magazine, and by reading the information contained in the information recording medium with a predetermined reading device, the type of medium to be used is automatically determined, and ink-droplet ejection is controlled so that the ink-droplets are ejected in an appropriate manner in accordance with the type of medium.

The medium 20 delivered from the medium supply unit 22 retains curl due to having been loaded in the magazine 32. In order to remove the curl, heat is applied to the medium 20 in the decurling unit 24 by a heating drum 34 in the direction opposite from the curl direction in the magazine 32. The heating temperature at this time is preferably controlled so that the medium 20 has a curl in which the surface on which the print is to be made is slightly round outward.

In the case of the configuration in which roll paper is used, a cutter (first cutter) 38 is provided as shown in FIG. 1, and the continuous paper is cut into a desired size by the cutter 38.

The cutter 38 has a stationary blade 38A, whose length is equal to or greater than the width of the conveyor pathway of the medium 20, and a round blade 38B, which moves along the stationary blade 38A. The stationary blade 38A is disposed on the reverse side of the printed surface of the medium 20, and the round blade 38B is disposed on the printed surface side across the conveyor pathway. When cut paper is used, the cutter 38 is not required.

The decurled and cut medium 20 is delivered to the electrostatic suction belt conveyance unit 26. The electrostatic suction belt conveyance unit 26 has a configuration in which an endless belt 43 is set around rollers 41 and 42 so that the portion of the endless belt 33 facing at least the nozzle faces of each print heads 12K, 12M, 12C, and 12Y forms a horizontal plane (flat plane).

The electrostatic suction belt 33 has a width that is greater than the width of the medium 20, and the DC high-voltage is applied to the belt 33 by a DC high-voltage generator 44. Therefore, the medium 20 is held on the belt 33 by electrostatic force.

The belt 33 is driven in the counterclockwise direction in FIG. 1 by the motive force of a motor 88 (not shown in FIG. 1, but shown in FIG. 7) being transmitted to at least one of the rollers 41 and 42, which the belt 43 is set around, and the medium 20 held on the belt 43 is conveyed from right to left in FIG. 1.

The surface potential sensor 25 is arranged upstream side of print head 12K, measures the potential on surface of the medium 20. The measurement signal from the surface potential sensor 25 is transferred to a calculation device 46 (corresponding to as system controller 72 in FIG. 7), and is fed back to control the DC high-voltage generator 44. More specifically, the calculation device 46 computes the targeted value for controlling electric voltage on the basis of measuring results of surface potential of the medium 20, and then produces control signal for controlling the output voltage from the DC high-voltage generator 44.

Each of the print heads 12K, 12M, 12C, and 12Y is composed of a line head, in which a plurality of ink-droplet ejection nozzles are arranged along a length that exceeds at least one side of the maximum-size medium 20 intended for use in the inkjet recording apparatus 10.

The print heads 12K, 12M, 12C, and 12Y are arranged in this order from the upstream side along the paper conveyance direction.

A color print can be formed on the medium 20 by ejecting the inks from the print heads 12K, 12M, 12C, and 12Y, respectively, onto the medium 20 while conveying the medium 20.

Although the configuration with the KMCY four standard colors is described in the present embodiment, combinations of the ink colors and the number of colors are not limited to those, and light and/or dark inks can be added as required. For example, a configuration is possible in which print heads for ejecting light-colored inks such as light cyan and light magenta are added.

The full-line heads 12K, 12M, 12C, and 12Y covering the entire width of the medium are thus provided for the respective ink colors, can record an image over the entire surface of the medium 20 by performing the action of moving the medium 20 and the print heads 12K, 12M, 12C, and 12Y relatively to each other in the sub-scanning direction just once (i.e., with a single sub-scan). Higher-speed printing is thereby made possible and productivity can be improved in comparison with a shuttle type head configuration in which a print head reciprocates in the main scanning direction.

The UV light sources 16A to 16D disposed between the print heads have a length corresponding to the maximum width of the medium 20, similarly to the print heads, and they are fixed extending in a direction substantially perpendicular to the conveyance direction of the medium 20. For example, the UV light sources 16A to 16D are constituted by a configuration of UV light emitting diode elements or UV laser diode elements arranged in a line. According to this composition, since light emission can be controlled selectively in each individual light-emitting element, it is possible readily to adjust the number of light emitting elements that light up, and the amount of light generated, and hence a prescribed irradiation range and light volume (intensity) can be achieved in the UV irradiation area.

The UV light sources 16A to 16D irradiate UV light in order to promote the hardening of ink droplets deposited by the heads 12K, 12M, 12C and 12Y, which are situated adjacently upstream of the light sources.

The UV light sources 16A to 16D are not necessarily required to harden and fix the ink droplets ejected onto the medium 20 by the preceding heads 12K, 12M, 12C and 12Y completely (namely, to change the droplets to a state where the setting reaction has completed), but they should harden the ink droplets on the medium 20 to a degree whereby there is no mixing or color blurring on the surface of the recording medium between the deposited ink droplets and ink droplets of other colors which are ejected from the subsequent heads 12M, 12C or 12Y. Furthermore, desirably, when the medium has passed the last UV light source 16D, hardening and fixing should be advanced to such a degree that no degradation of the image is caused by subsequent handling (in the downstream steps). This handling means, for example, (1) rubbing of the image surface against the rollers, conveyance guides, and the like, in the conveyance steps downstream of the second hardening device, (2) rubbing between prints in the print stacking section, and (3) rubbing of a finished print against various objects when it is actually handled for use.

In this way, the medium 20 (the created printed matter) that has passed the final UV light source 16D is output from the paper output unit 28 via nip rollers 47. Although not shown in FIG. 1, the paper output unit 28 is provided with a sorter for collecting images according to print orders.

Structure of the Print Head

Next, the structure of the print heads is described. The print heads 12K, 12M, 12C, and 12Y provided for the ink colors have the same structure, and a reference numeral 50 is hereinafter designated to any of the print heads 12K, 12M, 12C, and 12Y.

Figure 2A:
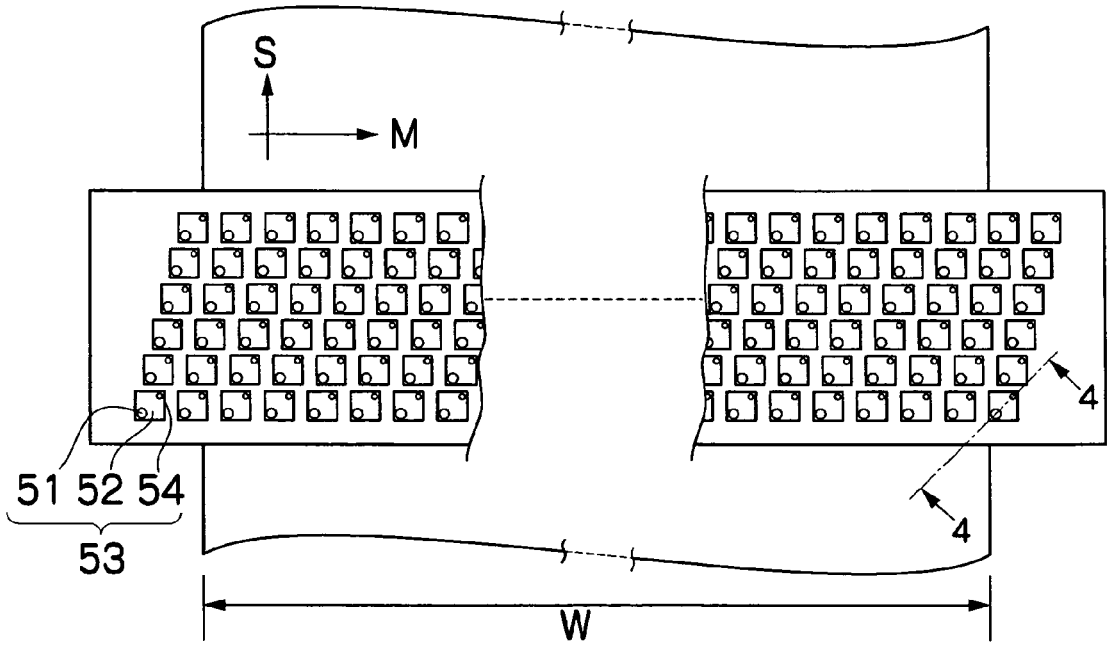
FIG. 2A is a perspective plan view showing an example of the configuration of the print head 50.
Figure 2B:
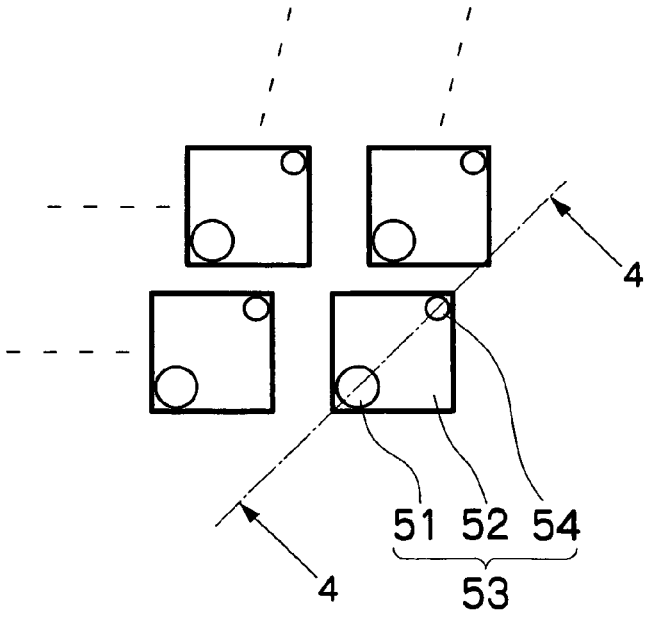
FIG. 2B is an enlarged view of a portion thereof.
Figure 3:
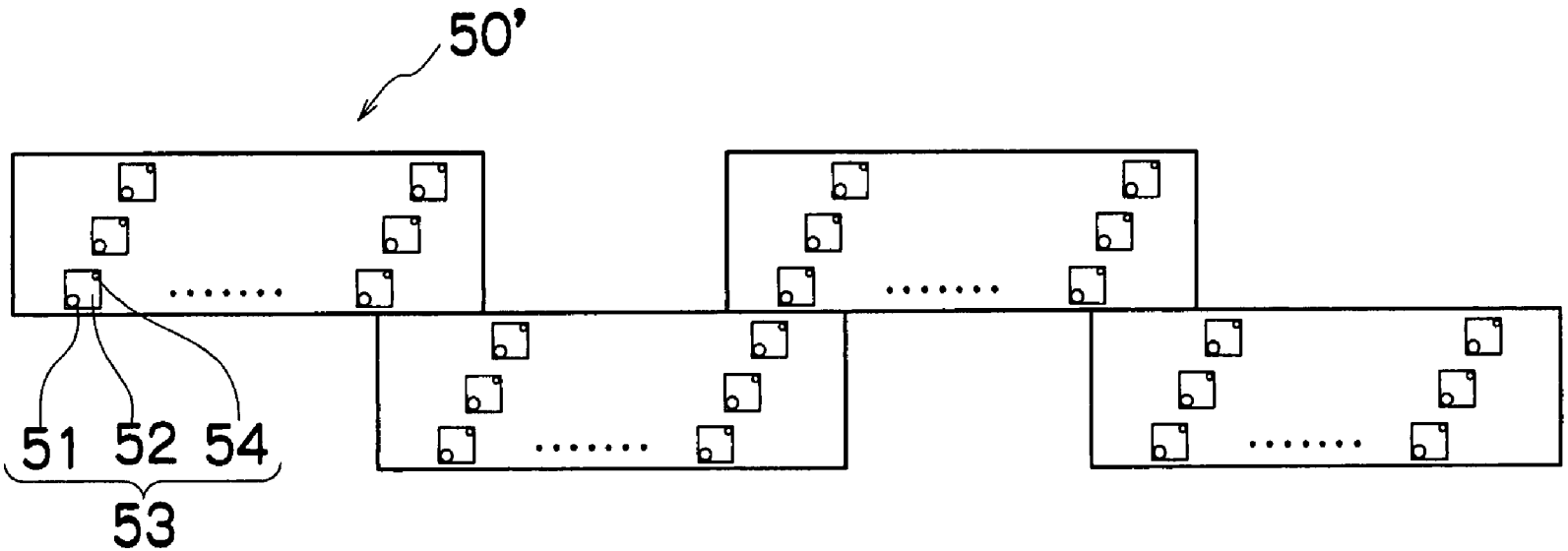
FIG. 3 is a perspective plan view showing another example of the configuration of the print head 50.
Figure 4:
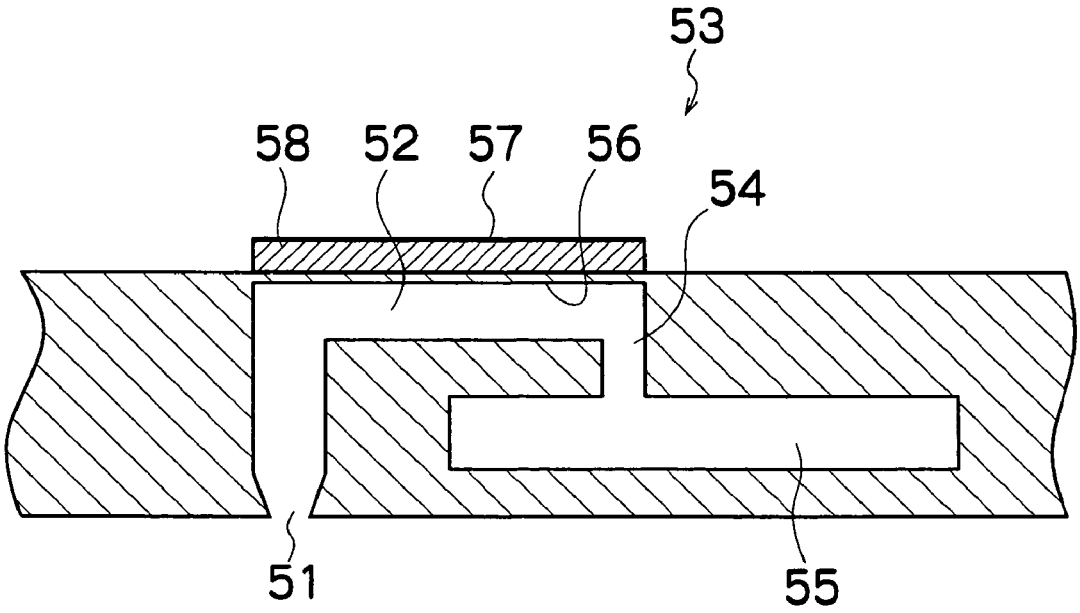
FIG. 4 is a cross-sectional view taken along the line 4-4 in FIGS. 2A and 2B, showing the inner structure of ink chamber unit corresponding to one nozzle.

FIG. 2A is a perspective plan view showing an example of the configuration of the print head 50, FIG. 2B is an enlarged view of a portion thereof, FIG. 3 is a perspective plan view showing another example of the configuration of the print head 50, and FIG. 4 is a cross-sectional view taken along the line 4-4 in FIGS. 2A and 2B, showing the inner structure of liquid droplet ejection element (an ink chamber unit corresponding to one nozzle 51).

The nozzle pitch in the print head 50 should be minimized in order to maximize the density of the dots printed on the surface of the recording paper. As shown in FIGS. 2A and 2B, the print head 50 in the present embodiment has a structure in which a plurality of ink chamber units (liquid droplet ejection elements) 53 including nozzles 51 for ejecting ink-droplets and pressure chambers 52 connecting to the nozzles 51 are disposed in the form of a staggered matrix (the two-dimensional form), and the effective nozzle pitch (the projection nozzle pitch) is thereby made small.

The print head 50 in the present embodiment is not limited to a full-line head in which one or more of nozzle rows in which the ink ejection nozzles 51 are arranged along a length corresponding to the entire width W of the medium 20 in the direction (the direction of arrow M) substantially perpendicular to the conveyance direction of the medium 20 (the direction of arrow S) as shown in FIG. 2A. Alternatively, as shown in FIG. 3, a full-line head can be composed of a plurality of short two-dimensionally arrayed head units 50' arranged in the form of a staggered matrix and combined so as to form nozzle rows having lengths that correspond to the entire width of the medium 20.

As shown in FIGS. 2A and 2B, the planar shape of the pressure chamber 52 provided for each nozzle 51 is substantially a square, and the nozzle 51 and a inflow port of supply ink (supply port) 54 are disposed in both corners on a diagonal line of the square.

As shown in FIG. 4, each pressure chamber 52 is connected to a common flow channel 55 through a supply port 54. The common flow channel 55 is connected to an ink tank (not shown in FIG. 4, but shown as numeral 60 in FIG. 6) in which is a source of ink supply. The ink supplied from ink tank 60 is supplied individually to each pressure chambers 52 through the common channel 55 in FIG. 4.

An actuator 58 having a discrete electrode 57 is joined to a pressure plate 56, which forms the ceiling of the pressure chamber 52, and the actuator 58 is deformed by applying drive voltage to the discrete electrode 57 to eject ink from the nozzle 51. When ink is ejected, new ink is delivered from the common flow channel 55 through the supply port 54 to the pressure chamber 52.

Figure 5:
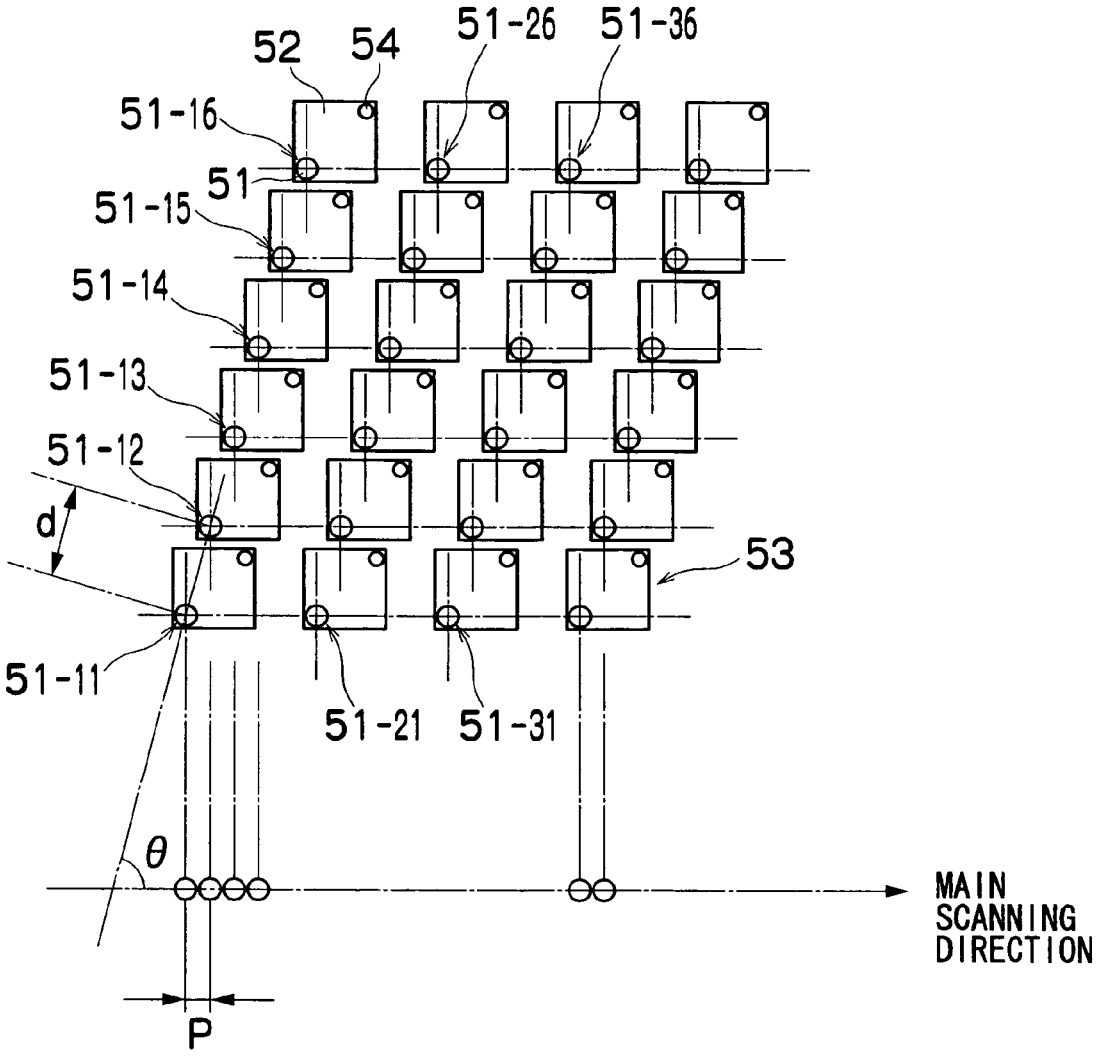
FIG. 5 is an enlarged view showing nozzle arrangement of the print head in FIG. 2A.

The plurality of ink chamber units 53 having such a structure are arranged in a grid with a fixed pattern in the line-printing direction along the main scanning direction and in the diagonal-row direction forming a fixed angle θ that is not a right angle with the main scanning direction, as shown in FIG. 5.

In other words, with the structure in which the plurality of rows of ink chamber units 53 are arranged at a fixed pitch d in the direction at the angle θ with respect to the main scanning direction, the nozzle pitch P as projected in the main scanning direction is d×cos θ. Hence, the nozzles 51 can be regarded to be equivalent to those arranged at a fixed pitch P on a straight line along the main scanning direction. Such configuration results in a nozzle structure in which the nozzle row projected in the main scanning direction has a high density of up to 2,400 nozzles per inch.

In a full-line head comprising rows of nozzles that have a length corresponding to the maximum recordable width, the "main scanning" is defined as to print one line (a line formed of a row of dots, or a line formed of a plurality of rows of dots) in the width direction of the recording paper (the direction perpendicular to the delivering direction of the recording paper) by driving the nozzles in one of the following ways: (1) simultaneously driving all the nozzles; (2) sequentially driving the nozzles from one side toward the other; and (3) dividing the nozzles into blocks and sequentially driving the blocks of the nozzles from one side toward the other.

In particular, when the nozzles 51 arranged in a matrix such as that shown in FIG. 5 are driven, the main scanning according to the above-described (3) is preferred. More specifically, the nozzles 51-11, 51-12, 51-13, 51-14, 51-15 and 51-16 are treated as a block (additionally; the nozzles 51-21, 51-22, . . . , 51-26 are treated as another block; the nozzles 51-31, 51-32, . . . , 51-36 are treated as another block, . . . ); and one line is printed in the width direction of the recording paper by sequentially driving the nozzles 51-11, 51-12, . . . , 51-16 in accordance with the conveyance velocity of the recording paper.

On the other hand, the "sub-scanning" is defined as to repeatedly perform printing of one line (a line formed of a row of dots, or a line formed of a plurality of rows of dots) formed by the main scanning, while moving the full-line head and the recording paper relatively to each other.

In the implementation of the present invention, the structure of the nozzle 10 arrangement is not particularly limited to the examples shown in the drawings. Moreover, the present embodiment adopts the structure that ejects ink-droplets by deforming the actuator 58 such as a piezoelectric element; however, the implementation of the present invention is not particularly limited to this. Instead of the piezoelectric inkjet method, various methods may be adopted including a thermal inkjet method in which ink is heated by a heater or another heat source to generate bubbles, and ink-droplets are ejected by the pressure thereof.

Configuration of Ink Supply System

Figure 6:
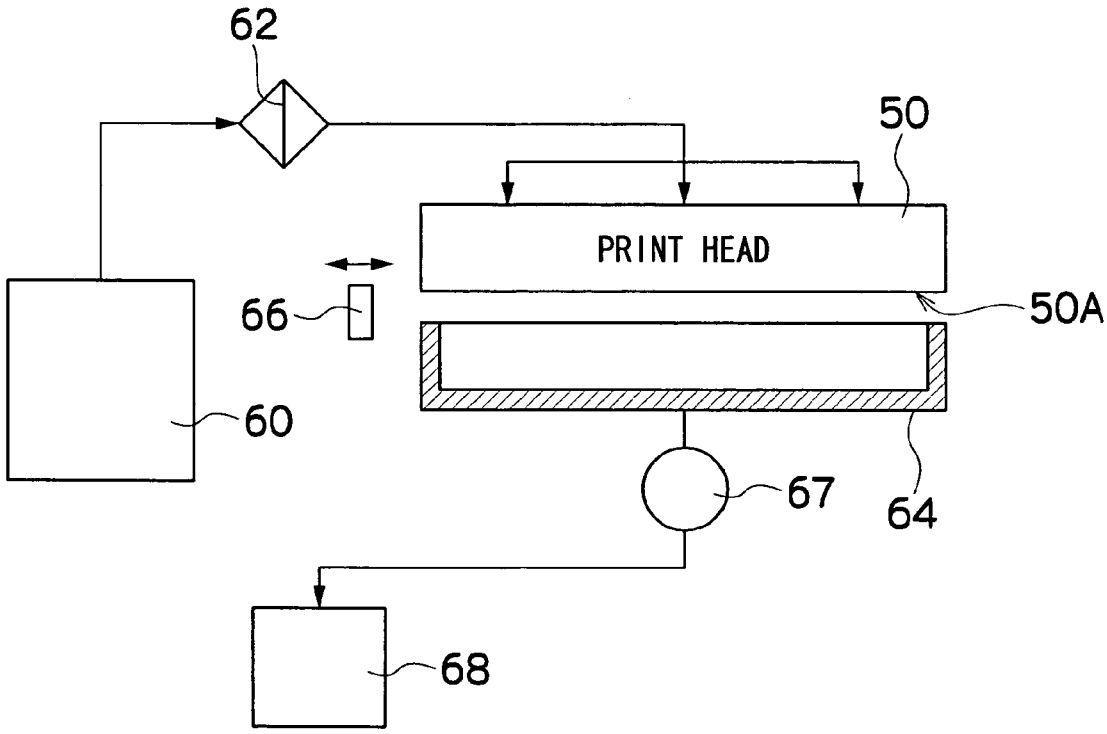
FIG. 6 is a schematic drawing showing the configuration of the ink supply system in the inkjet recording apparatus.

FIG. 6 is a schematic drawing showing the configuration of the ink supply system in the inkjet recording apparatus 10. An ink supply tank 60 is a base tank that supplies ink and is set in the ink storing/loading unit 14 described with reference to FIG. 1. The aspects of the ink supply tank 60 include a refillable type and a cartridge type: when the remaining amount of ink is low, the ink supply tank 60 of the refillable type is filled with ink through a filling port (not shown) and the ink supply tank 60 of the cartridge type is replaced with a new one. In order to change the ink type in accordance with the intended application, the cartridge type is suitable, and it is preferable to represent the ink type information with a bar code or the like on the cartridge, and to perform ejection control in accordance with the ink type. The ink supply tank 60 in FIG. 6 is equivalent to the ink storing/loading unit 14 in FIG. 1 described above.

A filter 62 for removing foreign matters and bubbles is disposed between the ink supply tank 60 and the print head 50, as shown in FIG. 6. The filter mesh size in the filter 62 is preferably equivalent to or less than the diameter of the nozzle and commonly about 20 μm. Although not shown in FIG. 6, it is preferable to provide a sub-tank integrally to the print head 50 or nearby the print head 50. The sub-tank has a damper function for preventing variation in the internal pressure of the head and a function for improving refilling of the print head.

The inkjet recording apparatus 10 is also provided with a cap 64 as a device to prevent the nozzle 51 from drying out or to prevent an increase in the ink viscosity in the vicinity of the nozzles, and a cleaning blade 66 as a device to clean the nozzle face 50A. A maintenance unit including the cap 64 and the cleaning blade 66 can be moved in a relative fashion with respect to the print head 50 by a movement mechanism (not shown), and is moved from a predetermined holding position to a maintenance position below the print head 50 as required.

The cap 64 is displaced up and down in a relative fashion with respect to the print head 50 by an elevator mechanism (not shown). When the power of the inkjet recording apparatus 10 is switched OFF or when in a print standby state, the cap 64 is raised to a predetermined elevated position so as to come into close contact with the print head 50, and the nozzle face 50A is thereby covered with the cap 64.

The cleaning blade 66 is composed of an elastic member such as rubber, and can be slid on the ink-droplet ejection surface (surface of the nozzle plate) of the print head 50 by a blade movement mechanism (not shown). When ink spray or foreign matters adhere to the nozzle plate, the nozzle plate surface is wiped and the nozzle plate surface cleaned by sliding the cleaning blade 66 on the nozzle plate.

During printing or standby, when the frequency of use of specific nozzles is reduced and ink viscosity increases in the vicinity of the nozzles, a preliminary ejection is made toward the cap 64 to eject the degraded ink.

Also, when bubbles have become intermixed in the ink inside the print head 50 (inside the pressure chamber), the cap 64 is placed on the print head 50, ink (ink in which bubbles have become intermixed) inside the pressure chamber is removed by suction with a suction pump 67, and the suction-removed ink is sent to a collection tank 68. This suction action entails the suctioning of degraded ink whose viscosity has increased (hardened) when initially loaded into the head, or when service has started after a long period of being stopped.

When a state in which ink is not ejected from the print head 50 continues for a certain amount of time or longer, the ink solvent in the vicinity of the nozzles 51 evaporates and ink viscosity increases. In such a state, ink can no longer be ejected from the nozzle 51 even if the actuator 58 is operated. Before reaching such a state the actuator 58 is operated (in a viscosity range that allows ejection by the operation of the actuator 58), and the preliminary ejection is made toward the ink receptor to which the ink whose viscosity has increased in the vicinity of the nozzle is to be ejected. After the nozzle surface is cleaned by a wiper such as the cleaning blade 66 provided as the cleaning device for the nozzle face 50A, a preliminary ejection is also carried out in order to prevent the foreign matter from becoming mixed inside the nozzles 51 by the wiper sliding operation. The preliminary ejection is also referred to as "dummy ejection", "purge", "liquid ejection", and so on.

When bubbles have become intermixed in the nozzle 51 or the pressure chamber 52, or when the ink viscosity inside the nozzle 51 has increased over a certain level, ink can no longer be ejected by the preliminary ejection, and a suctioning action is carried out as follows.

More specifically, when bubbles have become intermixed in the ink inside the nozzle 51 and the pressure chamber 52, ink can no longer be ejected from the nozzles even if the actuator 58 is operated. Also, when the ink viscosity inside the nozzle 51 has increased over a certain level, ink can no longer be ejected from the nozzle 51 even if the actuator 58 is operated. In these cases, a suctioning device to remove the ink inside the pressure chamber 52 by suction with a suction pump, or the like, is placed on the nozzle face 50A of the print head 50, and the ink in which bubbles have become intermixed or the ink whose viscosity has increased is removed by suction.

However, this suction action is performed with respect to all the ink in the pressure chamber 52, so that the amount of ink consumption is considerable. Therefore, a preferred aspect is one in which a preliminary ejection is performed when the increase in the viscosity of the ink is small.

Explanation about Control System

Figure 7:
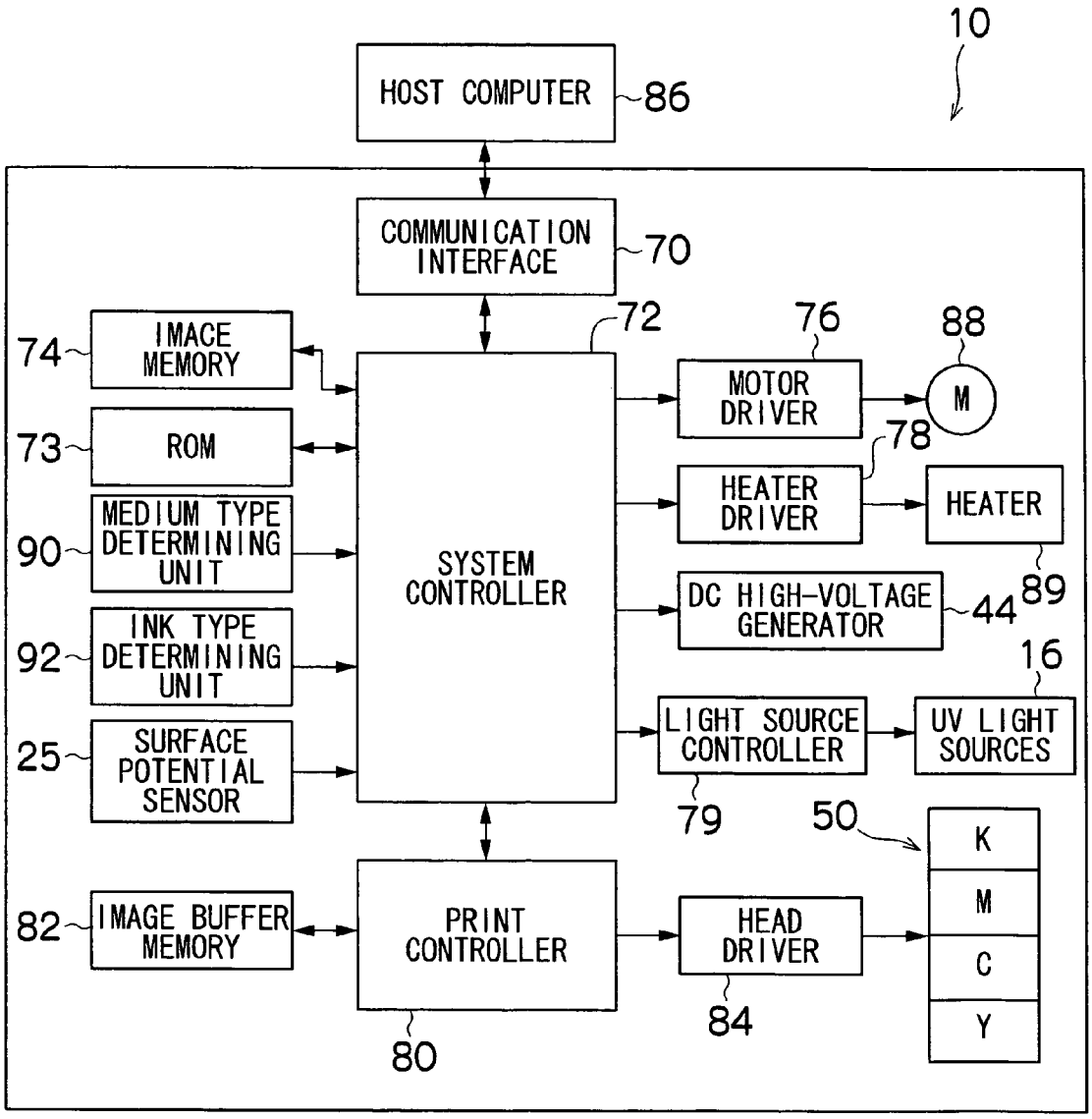
FIG. 7 is a block diagram of the principal components showing the system configuration of the inkjet recording apparatus.

FIG. 7 is a block diagram of the principal components showing the system configuration of the inkjet recording apparatus 10. The inkjet recording apparatus 10 has a communication interface 70, a system controller 72, ROM 73, an image memory 74, a motor driver 76, a heater driver 78, a light source controller 79, a print controller 80, an image buffer memory 82, a head driver 84, and other components.

The communication interface 70 is an interface unit for receiving image data sent from a host computer 86. A serial interface such as USB, IEEE1394, Ethernet, wireless network, or a parallel interface such as a Centronics interface may be used as the communication interface 70. A buffer memory (not shown) may be mounted in this portion in order to increase the communication speed. The image data sent from the host computer 86 is received by the inkjet recording apparatus 10 through the communication interface 70, and is temporarily stored in the image memory 74. The image memory 74 is a storage device for temporarily storing images inputted through the communication interface 70, and data is written and read to and from the image memory 74 through the system controller 72. The image memory 74 is not limited to memory composed of a semiconductor element, and a hard disk drive or another magnetic medium may be used.

The system controller 72 (corresponding to the electric field intensity controller) controls the communication interface 70, image memory 74, motor driver 76, heater driver 78, the DC high-voltage generator 44 (corresponding to the electric field application device), the light source controller 79 (corresponding to the fixing support device), the print controller 80, and other components. The system controller 72 has a central processing unit (CPU), peripheral circuits therefor, and the like. The system controller 72 controls communication between itself and the host computer 86, controls reading and writing from and to the image memory 74, and performs other functions, and also generates control signals for controlling the motor 88, a heater 89, and the DC high-voltage generator 44 in the conveyance system.

The ROM 73 stores programs executed by the CPU of the system controller 72, various data required for control procedures, and the like. It is preferable that the ROM 73 is a non-rewriteable storage device, or a rewriteable storage device such as an EEPROM. The image memory 74 is used as a temporary storage region for image data, and it is also used as a program development region and a calculation work region for the CPU.

The motor driver (drive circuit) 76 drives the motor 88 in accordance with commands from the system controller 72. The heater driver (drive circuit) 78 drives the heater 89 of the post-drying unit 42 or the like in accordance with commands from the system controller 72.

The light source controller 79 is constituted by comprising a light source control circuit which controls the lighting and extinguishing (ON/OFF operation) of the UV light sources 16 (the respective UV light sources indicated by reference numerals 16A to 16D in FIG. 1 being represented jointly by the reference numeral 16), and the lighting position and amount of light generated by the light sources 16. The light source controller 79 controls light emission by the respective UV light sources 16 in accordance with instructions from the system controller 72.

The print controller 80 has a signal processing function for performing various tasks, compensations, and other types of processing for generating print control signals from the image data stored in the image memory 74 in accordance with commands from the system controller 72 so as to apply the generated print control signals (print data) to the head driver 84. Required signal processing is performed in the print controller 80, and the ejection timing and ejection amount of the ink-droplets from the print head 50 are controlled by the head driver 84 on the basis of the image data. Desired dot sizes and dot placement can be brought about thereby.

The print controller 80 is provided with the image buffer memory 82; and image data, parameters, and other data are temporarily stored in the image buffer memory 82 when image data is processed in the print controller 80. The aspect shown in FIG. 7 is one in which the image buffer memory 82 accompanies the print controller 80; however, the image memory 74 may also serve as the image buffer memory 82. Also possible is an aspect in which the print controller 80 and the system controller 72 are integrated to form a single processor.

The head driver 84 drives actuators for the print heads 12K, 12M, 12C, and 12Y of the respective colors on the basis of the print data received from the print controller 80. A feedback control system for keeping the drive conditions for the print heads constant may be included in the head driver 84.

The image data to be printed is externally inputted through the communications interface 70, and is stored in the image memory 74. At this stage, RGB image data is stored in the image memory 74, for example. The image data stored in the image memory 74 is sent to the print controller 80 through the system controller 72, and is converted to the dot data for each ink color by a known dithering algorithm, random dithering algorithm or another technique in the print controller 80.

The print head 50 is driven on the basis of the dot data thus generated by the print controller 80, so that ink is ejected from the head 50. By controlling ink ejection from the head 50 in synchronization with the conveyance speed of the medium 20, an image is formed on the medium 20.

Furthermore, the image forming apparatus 10 comprises a medium type determining unit 90 for acquiring information on the type of medium, and an ink type determining unit 92 for acquiring information on the type of ink. The information thus acquired is supplied to the system controller 72.

The medium type determining unit 90 is a device for determining the paper type and size of the medium 20. This section uses, for example, a device for reading in information such as bar codes attached to the magazine 32 in the medium supply unit 22, or sensors disposed at a suitable position in the paper conveyance path (a paper width determination sensor, a sensor for determining the thickness of the paper, a sensor for determining the reflectivity of the paper, and so on). A suitable combination of these elements may also be used. Furthermore, it is also possible to adopt a composition in which information relating to the paper type, size, or the like, is specified by means of an input via a prescribed user interface, instead of or in conjunction with such automatic determining devices.

For the device for acquiring information on the ink type, it is possible to use, for example, a device which reads in ink properties information from the shape of the cartridge in the ink tank 60 (a specific shape which allows the ink type to be identified), or from a bar code or IC chip incorporated into the cartridge. Besides this, it is also possible for an operator to input the required information by means of a user interface.

The system controller 72 calculates a control target value for the electric field intensity for electrostatic attraction on the basis of the information obtained from the medium type determining unit 90 and the ink type determining unit 92, and the determination signal from the surface potential sensor 25, and it controls the DC high-voltage generator 44 on the basis of the result of this calculation.

An electrorheological fluid (dispersed fluid) subjected to an electric field from an external source has a property whereby it will not flow unless the externally applied stress $\tau$ exceeds a certain uniform value $\tau y$ (the yield stress). Furthermore, the value of this yield stress $\tau y$ depends on the properties of the electrorheological fluid and the intensity of the electric field applied to the electrorheological fluid. In other words, by setting the yield stress $\tau y$ to an appropriate value, it is possible to halt the flow of the ink droplets after their deposition on the medium 20, and hence beneficial effects can be obtained in terms of improving printing quality.

For example, in respect of ink smearing and spreading, the yield stress $\tau y$ is set so as to satisfy the following Condition (1):

$$\text{(Capillary force between ink and medium)} < \text{(Yield stress } \tau y \text{ of ink)}. \quad (1)$$

Furthermore, in respect of interference on the medium between ink droplets of the same color or different colors, and movement of the liquid on the medium, the yield stress $\tau y$ is set so as to satisfy the following Condition (2):

$$\text{(Aggregation force between ink droplets)} < \text{(Yield stress } \tau y \text{ of ink)}. \quad (2)$$

Moreover, by setting the yield stress $\tau y$ in such a manner that it satisfies both Condition (1) and Condition (2) stated above, and then applying an electric field intensity corresponding to this yield stress value, it is possible to prevent ink smearing and spreading at the same time as avoiding interference between ink droplets of the same color or different colors, and movement of the liquid, on the surface of the medium 20.

Next, the operation of the image forming apparatus 10 having the foregoing composition will be described.

An electric field caused by electrostatic attraction is applied to the medium 20 held on the electrostatic suction belt 43. The electric potential at the surface of the medium 20 is measured by the surface potential sensor 25, and the voltage applied by the DC high-voltage generator 44 is controlled on the basis of this measurement result, in such a manner that the surface potential has a prescribed target value.

In this way, ink is ejected from the head 50 toward the medium 20, which is applied with an electric field of a prescribed intensity. The viscosity of ink that has landed on the medium 20 is raised instantaneously by the action of the electric field, and hence permeation of the ink into the medium 20 and spreading of the dot size are restricted. Furthermore, interference between ink droplets on the medium 20 and movement of the liquid are also restricted. In this state, UV light is irradiated from a UV light source 16 onto the ink on the medium 20, and hence the ink is set and fixed while in a satisfactory liquid state.

A similar process is carried out sequentially for the respective colors, KMCY, and the ink is fixed almost completely by passing the final UV light source 16D. Therefore, when the medium 20 is subsequently separated from the electrostatic suction belt 43 and an electric field is no longer applied to same, the ink will already be fixed sufficiently to a degree which prevents further smearing, or the like. Thereby, not only is it possible to reduce smearing and excessive spreading of the dots, and the like, but smearing (bleeding) caused by intermixing of inks of different colors can also be avoided, and hence high-quality image formation can be achieved.

Second Embodiment

Figure 8:
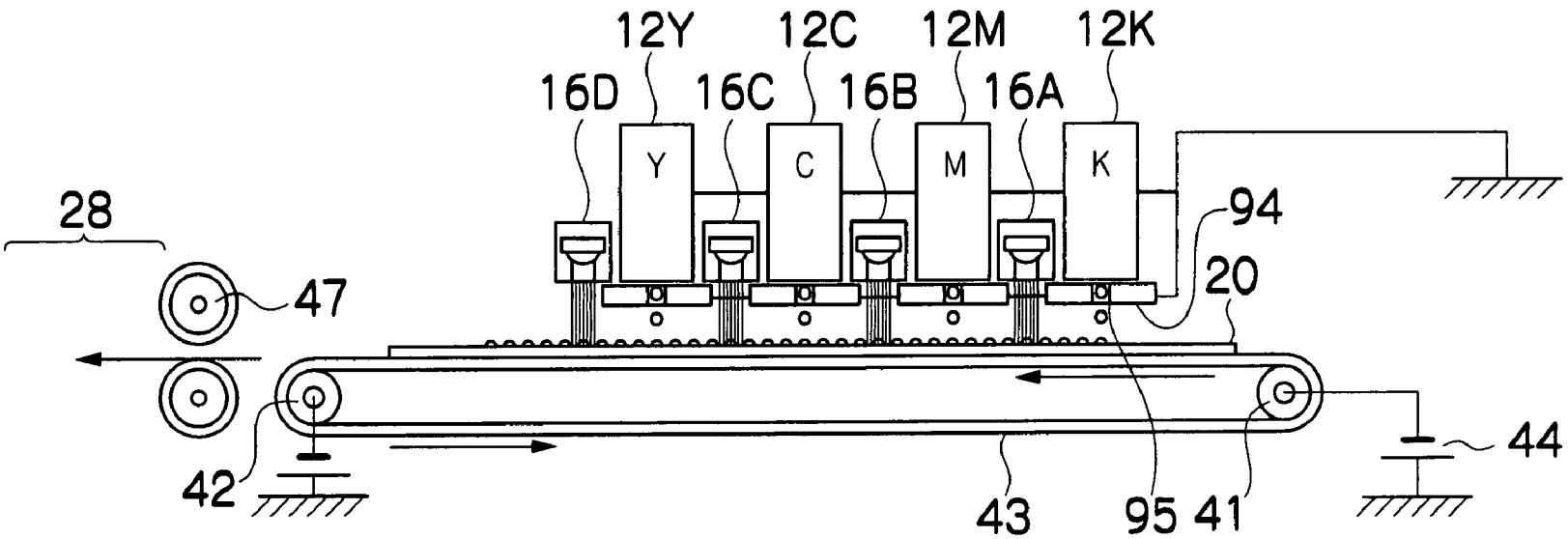
FIG. 8 is a schematic drawing showing the principal components of an image forming apparatus relating to a second embodiment of the present invention.

FIG. 8 is a schematic drawing showing the principal components of an image forming apparatus relating to a second embodiment of the present invention. In FIG. 8, members which are the same as or similar to those in FIG. 1 are labeled with the same reference numerals and description thereof is omitted here. In addition to the composition shown in FIG. 1, desirably, a composition is added in which earthed electrode plates 94 are respectively disposed immediately below the nozzle surfaces of the heads 12K, 12M, 12C and 12Y, and the frames of the heads 12K, 12M, 12C and 12Y are also earthed, as shown in FIG. 8. Of course, holes 95 are formed in the electrode plates 94 in order that the liquid ejected from the nozzles 51 can pass through same, but apart from the area of these holes 95, the ejection surfaces of the head 50 are covered and hence the electrode plates 94 function as electromagnetic shielding members.

By means of this composition, the flow of the lines of electric force between the electrode plates 94 and the electrostatic suction belt 43 facing same can be controlled, and hence the effects of the electric field on the head can be reduced by the electrode plates 94 and increase in the viscosity of the ink inside the nozzles 51 can be prevented.

Third Embodiment

Figure 9:
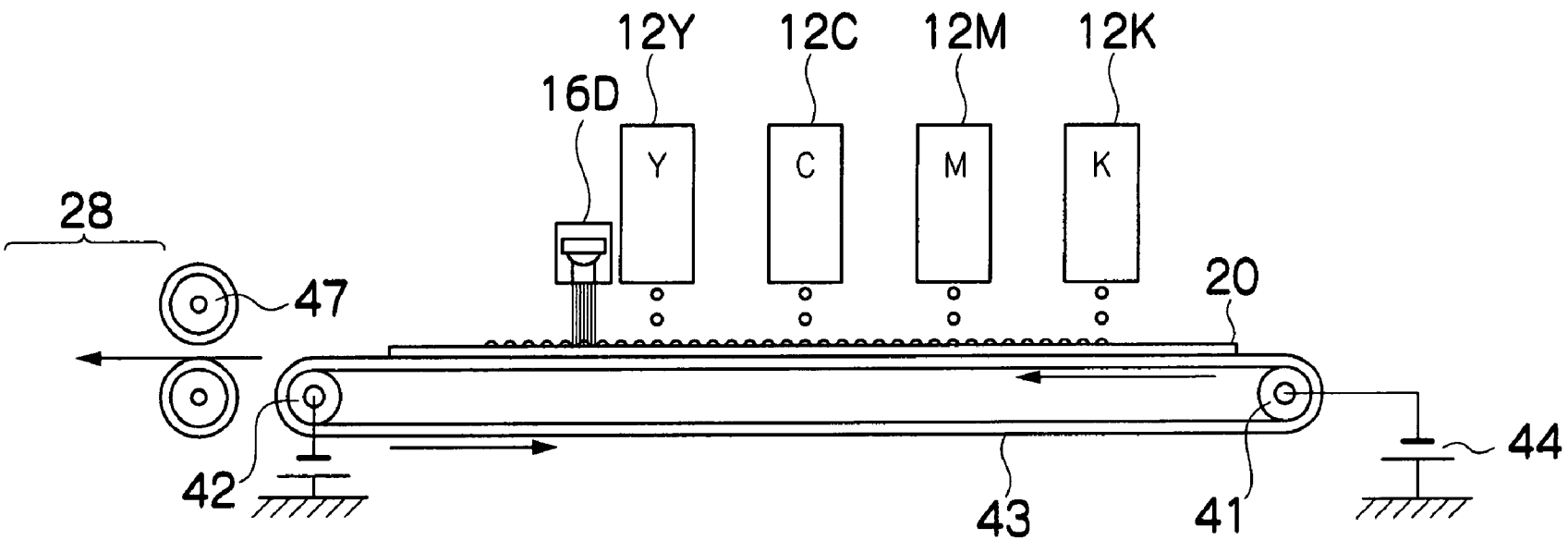
FIG. 9 is a schematic drawing showing the principal components of an image forming apparatus relating to a third embodiment of the present invention.

FIG. 9 is a schematic drawing showing the principal components of an image forming apparatus relating to a third embodiment of the present invention. In FIG. 9, members which are the same as or similar to those in FIG. 1 are labeled with the same reference numerals and description thereof is omitted here. In FIG. 1, UV light sources 16A to 16D are provided respectively downstream of the heads 12K, 12M, 12C and 12Y and UV light is irradiated separately for each ink color. However, instead of this composition, it is also possible to adopt a configuration in which a UV light source 16D is only provided downstream of the last color head (in this case, the yellow head 12Y) as shown in FIG. 9, and UV light is irradiated only once by this UV light source 16D.

Since an electric field continues to be applied to the ink droplets deposited on the medium 20, during the holding and conveyance of the medium 20 on the electrostatic suction belt 43, it is possible to prevent smearing between colors by means of the electrorheological effect. Therefore, satisfactory image formation can be achieved, even if UV light is irradiated only once, after droplets of the last color have been deposited, as shown in FIG. 9. In this case, the UV light sources 16A to 16C illustrated in FIG. 1 can be omitted, and hence the overall composition of the apparatus can be simplified.

Fourth Embodiment

Figure 10:
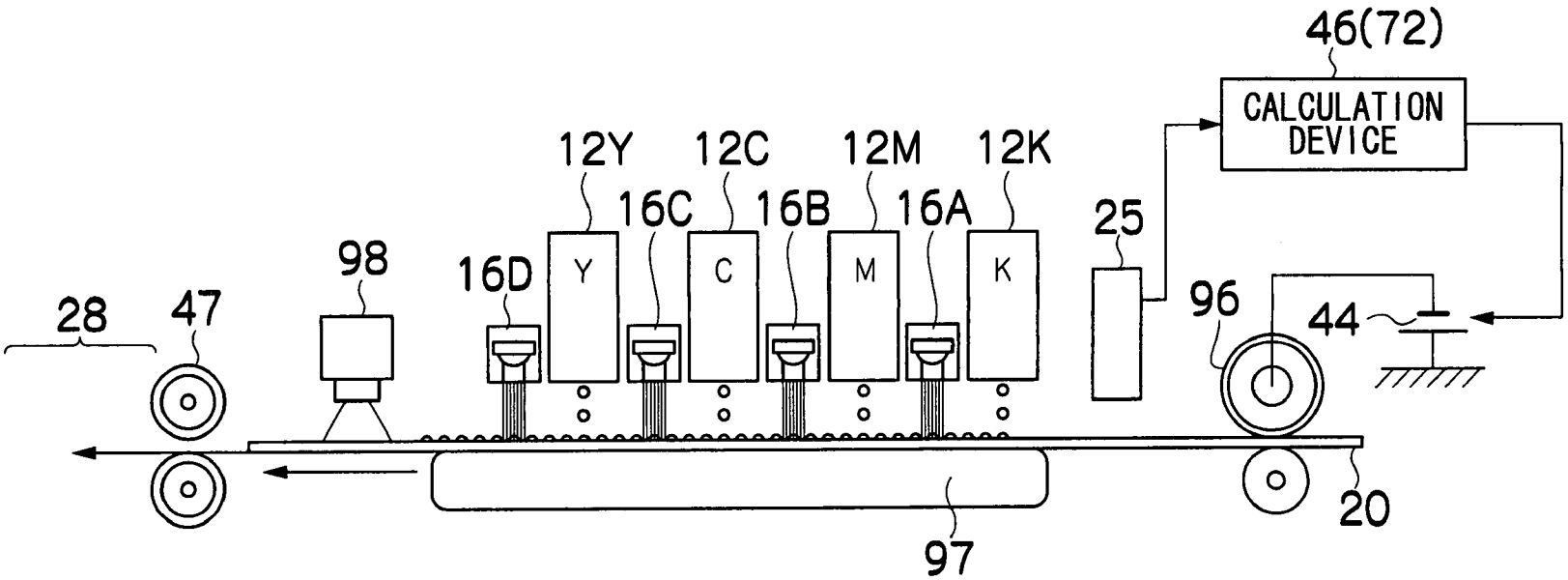
FIG. 10 is a schematic drawing showing the principal components of an image forming apparatus relating to a fourth embodiment of the present invention.

FIG. 10 is a schematic drawing showing the principal components of an image forming apparatus relating to a fourth embodiment of the present invention. In FIG. 10, members which are the same as or similar to those in FIG. 1 are labeled with the same reference numerals and description thereof is omitted here.

FIG. 10 shows an example where roller conveyance is used instead of conveyance by an electrostatic suction belt. Here, an electrically conductive rubber roller 96 is used in order to apply an electric field to the medium 20. The conductive rubber roller 96 is disposed on the upstream side of the first color head (in this case, the black head 12K), and it is connected to the DC high-voltage generator 44. The conductive rubber roller 96 makes contact with the surface of the medium 20 before droplets are deposited thereon, and it thus imparts an electric charge to the surface of the medium 20. In this case, by measuring the electric potential at the surface of the medium 20 by the surface potential sensor 25, and controlling the DC high-voltage generator 44 on the basis of this measurement result, the potential at the surface of the medium 20 can be kept to a suitable state at all times. It should be noted that in FIG. 10, reference numeral 97 indicates a guide member for conveying the medium, which functions as an electrode.

Furthermore, a static-elimination device 98 for removing the charge from the charged medium 20 is disposed after the final UV light source 16D. By removing the charge from the medium 20 when printing has been completed, it is possible to prevent the medium 20 from attracting other media, dust, or the like.

Fifth Embodiment

Figure 11:
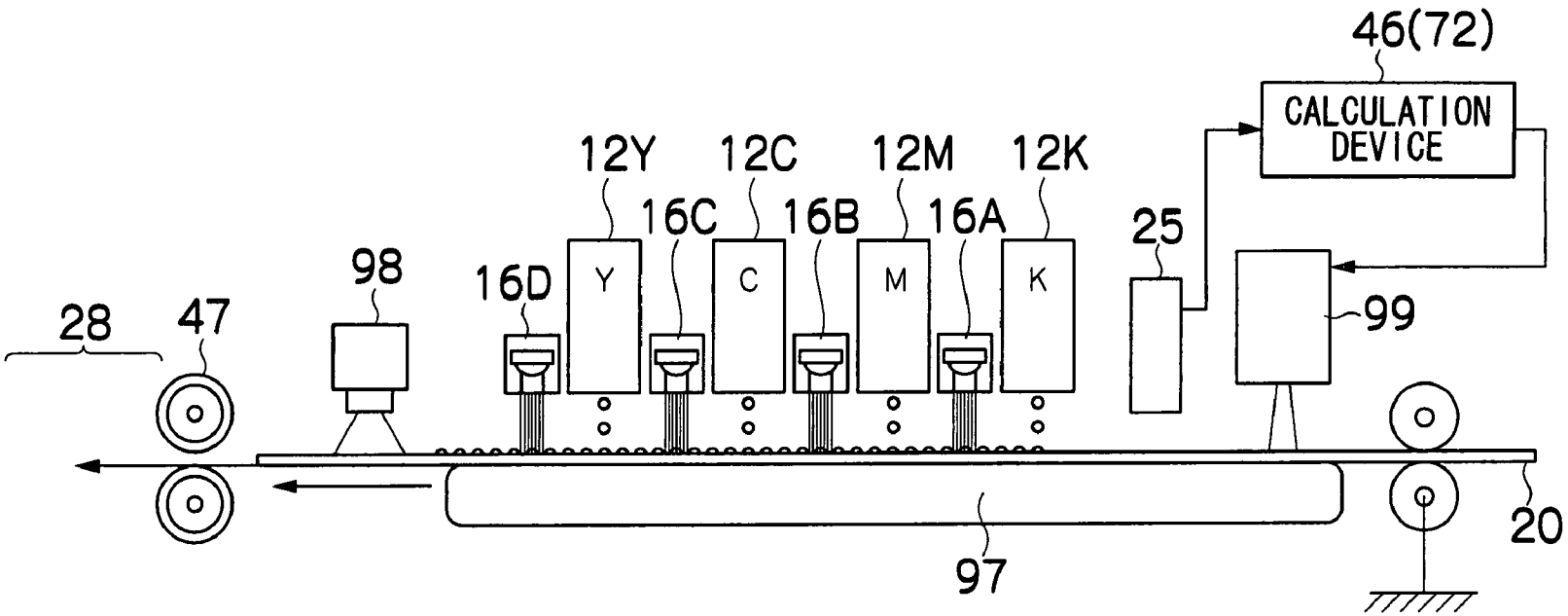
FIG. 11 is a schematic drawing showing the principal components of an image forming apparatus relating to a fifth embodiment of the present invention.

FIG. 11 is a schematic drawing showing the principal components of an image forming apparatus relating to a fifth embodiment of the present invention. In FIG. 11, members which are the same as or similar to those in FIG. 10 are labeled with the same reference numerals and description thereof is omitted here. Instead of the conductive rubber roller 96 described in FIG. 10, it is also possible to adopt a composition in which the surface of the medium 20 is charged in a non-contact fashion, by irradiating ions onto the medium 20 using an ion generator 99, as illustrated in FIG. 11. In this case, by measuring the electric potential at the surface of the medium 20 by the surface potential sensor 25 and controlling the amount of ion irradiation output by the ion generator 99 on the basis of this measurement result, the potential at the surface of the medium 20 can be kept to a suitable state at all times.

The foregoing description related to examples where UV-curable ink is used, but in implementing the present invention, the ink is not limited to a light-curable ink, and other radiation-curable inks which are set by electron beams, X rays, or the like, may also be used. In this case, a fixing promotion processing unit using a radiation source suitable for activating the hardening agent (namely, activating polymerization) is provided, according to the type of ink used.

In the respective embodiments described above, an inkjet recording apparatus using a page-wide full line type head having a nozzle row of a length corresponding to the entire width of the recording medium is described, but the scope of application of the present invention is not limited to this, and the present invention may also be applied to an inkjet recording apparatus using a shuttle head which performs image recording while moving a short recording head reciprocally.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An image forming apparatus, comprising:

an ejection head which ejects ink having electrorheological properties toward a recording medium;

an electric field application device which applies an electric field to droplets of the ink deposited on a surface of the recording medium;

an electric field intensity control device which controls intensity of the electric field in such a manner that the ink in the droplets has a prescribed viscosity; and a fixing promotion device which carries out processing for promoting fixing of the ink on the recording medium, in a state where the electric field is applied by the electric field application device.

2. The image forming apparatus as defined in claim 1, further comprising:

a medium information acquiring device which acquires information relating to a state of the recording medium, wherein the electric field intensity control device controls the electric field intensity according to the information acquired by the medium information acquiring device.

3. The image forming apparatus as defined in claim 2, wherein the medium information acquiring device comprises a surface potential determining device which determines an electric potential at the surface of the recording medium.

4. The image forming apparatus as defined in claim 2, wherein the medium information acquiring device comprises a recording medium type determining device which determines a type of the recording medium.

5. The image forming apparatus as defined in claim 1, wherein:

the ink is a radiation-curable ink; and the fixing promotion device comprises a radiation irradiating device which irradiates radiation that causes the ink to harden.

6. The image forming apparatus as defined of claim 1, further comprising:

an electrostatic attraction device which holds the recording medium by means of electrostatic attraction, wherein the electrostatic attraction device functions as the electric field application device.

7. The image forming apparatus as defined in claim 1, further comprising an earthed electrode member which is arranged on at least an ejection surface side of the ejection head.

8. The image forming apparatus as defined in claim 1, further comprising a static-elimination device which removes electrical charge from the recording medium after processing by the fixing promotion device.

9. An image forming method, comprising:

an ink ejection step of ejecting ink having electrorheological properties toward a recording medium from an ejection head;

an electric field application step of applying an electric field to droplets of the ink deposited on a surface of the recording medium;

an electric field intensity control step of controlling intensity of the electric field in such a manner that the ink in the droplets has a prescribed viscosity; and a fixing promotion step of carrying out processing for promoting fixing of the ink on the recording medium, in a state where the electric field is applied in the electric field application step.

10. The image forming apparatus of claim 1, wherein the electric field application device applies the electric field based on a type of medium the ink is being applied to, a type of ink stored in the ejection head, and a surface potential of the recording medium.

11. The image forming apparatus of claim 1, wherein the electric field intensity control device controls intensity of the electric field based on the prescribed viscosity of the ink droplets on the recording medium.

* * * * *